US006679557B2

(12) United States Patent
Craft et al.

(10) Patent No.: US 6,679,557 B2
(45) Date of Patent: Jan. 20, 2004

(54) ARTICLE OF FURNITURE HAVING A SUPPORT MEMBER WITH AN ADJUSTABLE CONTOUR

(75) Inventors: Raymond E. Craft, Avilla, IN (US); Randall L. Bixler, LaGrange, IN (US)

(73) Assignee: Pent Products, Inc., Kendallville, IN (US)

( * ) Notice: Subject to any disclaimer, the term of this patent is extended or adjusted under 35 U.S.C. 154(b) by 0 days.

(21) Appl. No.: 10/055,042

(22) Filed: Jan. 23, 2002

(65) Prior Publication Data

US 2003/0137178 A1 Jul. 24, 2003

(51) Int. Cl.[7] ..... A47C 7/02

(52) U.S. Cl. ..... 297/452.41; 297/284.6; 297/284.1; 297/284.4; 5/709

(58) Field of Search ..... 297/452.41, 284.6, 297/284.1, 284.4, 284.5, 284.7; 5/709, 654, 657, 420

(56) References Cited

U.S. PATENT DOCUMENTS 3,864,766 A * 2/1975 Prete, Jr. ..... 5/644
5,033,133 A * 7/1991 Nissen ..... 5/653
5,190,348 A * 3/1993 Colasanti ..... 297/284.6
5,314,235 A * 5/1994 Johnson ..... 297/284.5
5,617,595 A * 4/1997 Landi et al. ..... 5/653
5,658,050 A * 8/1997 Lorbiecki ..... 297/452.41
5,711,575 A 1/1998 Hand et al. ..... 297/284.6
5,893,184 A * 4/1999 Murphy ..... 297/452.41
5,902,011 A 5/1999 Hand et al. ..... 297/284.6
6,036,271 A * 3/2000 Wilkinson et al. ..... 297/452.41

* cited by examiner

*Primary Examiner*—Peter M. Cuomo
*Assistant Examiner*—Erika Garrett
(74) *Attorney, Agent, or Firm*—Taylor & Aust, P.C.

(57) ABSTRACT

An article of furniture includes a support having a support surface. A plurality of air bladders are positioned relative to the support surface, each air bladder having expandable foam therein. At least one fluid line fluidly couples the air bladders together. A single valve is fluidly coupled with the at least one fluid line. A contoured cushion has an inner contoured portion generally conforming to said plurality of air bladders. The plurality of air bladders are mounted between the support surface and the contoured cushion.

18 Claims, 3 Drawing Sheets

ARTICLE OF FURNITURE HAVING A SUPPORT MEMBER WITH AN ADJUSTABLE CONTOUR

BACKGROUND OF THE INVENTION

1. Field of the Invention

The present invention relates to an article of furniture, and, more particularly, to an article of furniture capable of being sat upon and/or reclined in by a user.

2. Description of the Related Art

Articles of furniture such as seats, chairs, recliners, couches and sofas are available for sitting upon and/or reclining in. Certain of these articles have at least one support surface that is provided with an extra mechanical support mechanism, commonly in the seat back for the lumbar region of the back of a user. Such an extra support mechanism typically is mechanically biased. Sometimes, a lever is provided for moving and thereby adjusting the position of the mechanical support mechanism to maximize the comfort of the user. That lever may require a significant effort to reach and adjust, especially with respect to a car seat.

What is needed in the art is an extra support mechanism associated with a support surface of an article of furniture that permits the extra support mechanism to be positioned and contoured for the comfort of a particular user and then easily held in that particular contour.

SUMMARY OF THE INVENTION

The present invention provides an air-regulated, cushioned unit for a support of an article of furniture which has multiple air bladders associated therewith, the air bladders being readily positioned and contoured for the comfort of a particular user and then easily held in that particular contour.

The invention comprises, in one form thereof, an article of furniture including a support having a support surface. A plurality of air bladders are mounted relative to the support surface, each air bladder having expandable foam therein. At least one fluid line fluidly couples the air bladders together. A single valve is fluidly coupled with the at least one fluid line. A contoured cushion is attached to the support surface. The at least one fluid line and the air bladders are mounted between the support surface and the contoured cushion.

An advantage of the present invention is the air bladder system of the present invention, by using hydrodynamics, permits an article of furniture to be contoured for the comfort of a particular user and then easily held in that particular contour even after that particular user vacates that article of furniture.

Another advantage is that the contour can be held in place or adjusted by working a single valve.

An additional advantage is that the foam in each air bladder is naturally biased toward its full size, and, consequently, the air bladders will automatically tend to expand to their full size upon opening of the system valve, thus requiring no pump to expand any bladder.

Yet another advantage is the air bladder system may either be made a permanent or a temporary part of a given article of furniture.

An even yet further advantage is that the use of a contoured cushion eliminates the need for a further support mechanism to hold the air bladders and the at least one fluid line in place relative to the support surface.

BRIEF DESCRIPTION OF THE DRAWINGS

The above-mentioned and other features and advantages of this invention, and the manner of attaining them, will become more apparent and the invention will be better understood by reference to the following description of embodiments of the invention taken in conjunction with the accompanying drawings.

DETAILED DESCRIPTION OF THE INVENTION

Figure 1:
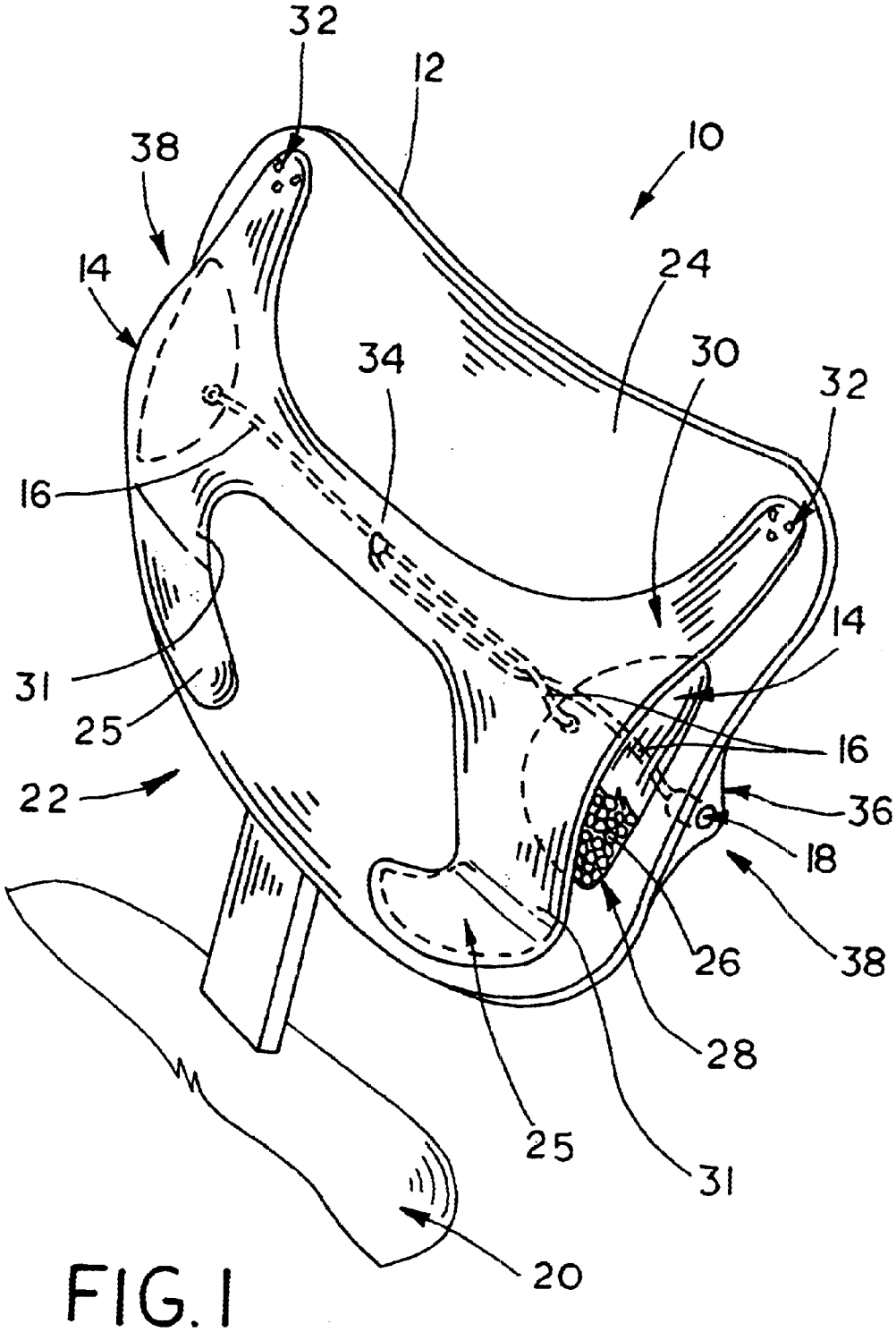
FIG. 1 is a partial cut-away view of an article of furniture of the present embodiment.

Referring now to FIG. 1, there is shown an article of furniture 10 which generally includes a support 12, a plurality of air bladders 14, at least one air line 16 (shown in phantom) and a single valve 18.

Article of furniture 10 in the present embodiment is a chair with a seat 20 and a seat back 22. In the present embodiment, seat back 22 is support 12. Support 12 has a support surface 24 with a plurality of air bladders 14, at least one air line 16 (shown in phantom) and a single valve 18 mounted thereon. Support surface 24 has at least one pocket 25 mounted thereon which, as to be explained in greater detail later, allows air bladders 14 to be mounted to support surface 24 while permitting access thereto.

Air bladders 14 are mounted relative to support surface 24, each air bladder 14 having expandable foam 26 (shown in a partial cut-away in one of air bladders 14) therein. Expandable foam 26 has an expanded state 28 (as shown) and a compressed state (not shown). Expandable foam 26, having an open cell structure, is characteristically biased toward expanded state 28, unless held in the compressed state by an outside force. The presence of expandable foam 26 within each air bladder 14 permits each air bladder to assume and be held in a particular inflation state (i.e., that created by someone sitting in article of furniture 10) upon compression of each air bladder 14.

Air bladders 14 are held in place on support surface 24, at least in part, by a flexible support member 30. Flexible support member 30, in the present embodiment, is mounted to support surface 24 permanently, as by welds 32 or some other type of metallurgical or adhesive joints. At least one lower segment 31 of flexible support member 30 is removably inserted via a slip fit into one of at least one pocket 25, to help hold air bladders 14 in place yet allow easy access thereto. Further, air bladders 14 and flexible support member 30, when mounted on seat back 22, together are configured for providing lumbar support.

Air bladders 14 are fluidly connected to each other by air lines 16. Air lines 16 are mounted so as to be positioned between flexible support member 30 and support surface 24. Such positioning serves to protect air lines 16 and to keep them from view, even if no further cushioning is provided with respect to support surface 24.

Air lines 16 are connected in parallel via line connector 34. Air lines 16 may be made of, for example, rubber, plastic, polyvinyl chloride (PVC), or metal.

One of air lines 16 is connected to single valve 18. Single valve 18 is preferably mounted at a perimeter location 36 of support 12 to make it readily accessible and locatable for a person sitting in article of furniture 10. Single valve 18 is configured to be selectively closed to prevent air from flowing into air bladders 14 and thereby prevent further biasing of expandable foam 26 toward expanded state 28 thereof. Conversely, single valve 18 can be opened to permit airflow thereinto and thus allow expandable foam 26 to return to expanded state 28. Single valve 18 may be, for example, a spring-loaded pull valve or a turn valve.

Air bladder system 38, which includes air bladders 14, air lines 16, single valve 18 and flexible support member 30, of a support 12 can be adjusted. Single valve 18 is opened to permit travel of air therethrough. Depending on how a person chooses to sit in article of furniture 10, at least one air bladder 14 and expandable foam 26 associated therewith is compressed, thereby forcing at least a portion of the air from expandable foam 26. That portion of the air escapes into at least one air line 16 and out through open single valve 18. Single valve 18 is closed to prevent ingress of air into expandable foam 26 of at least one compressed air bladder 14, thereby retaining at least one compressed air bladder 14 in an at least partially compressed state. The adjustment may include a further step of opening single valve 18 to allow the ingress of air into expandable foam 26, thereby permitting expandable foam 26 to fill with air and expand.

Figure 2:
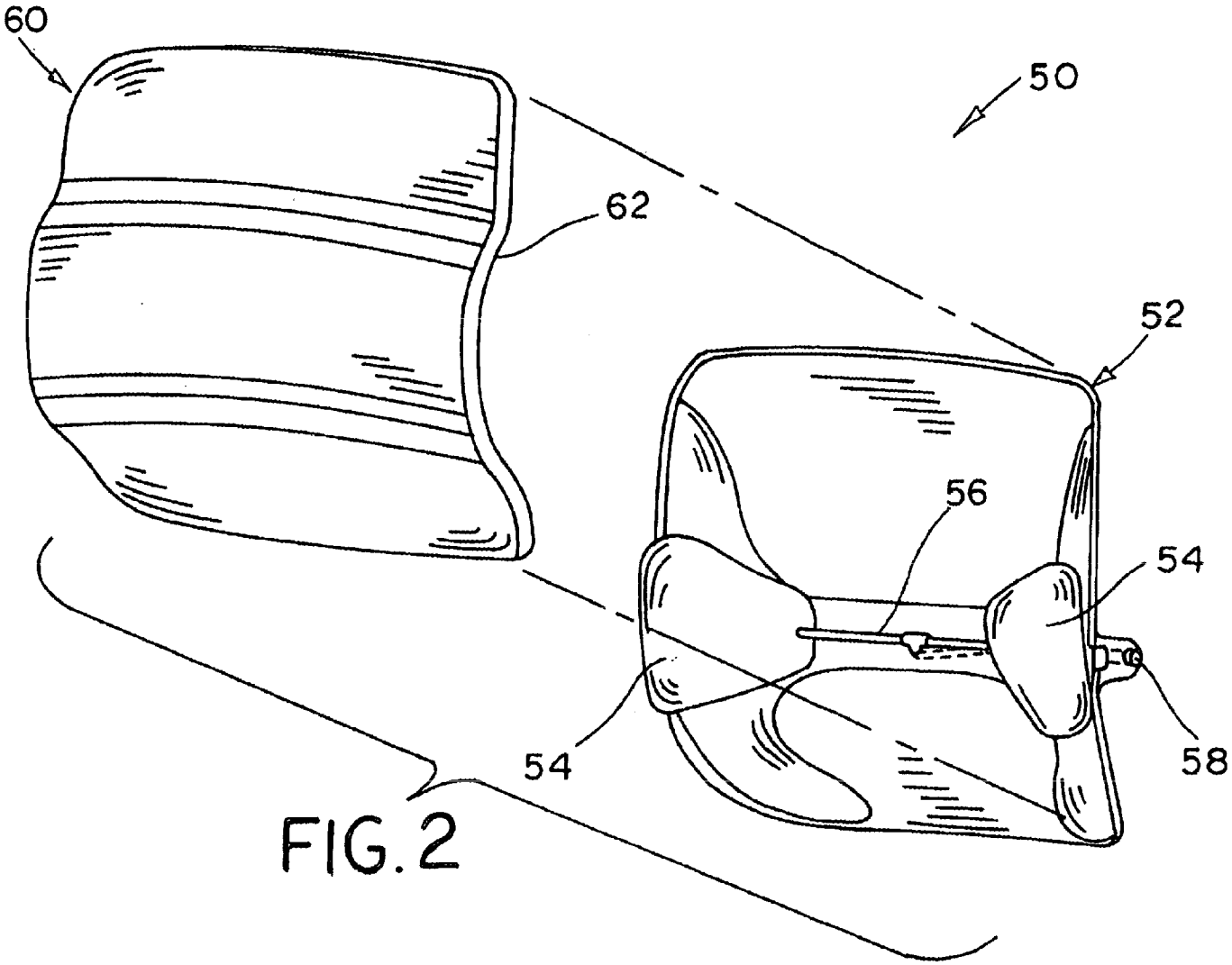
FIG. 2 is an exploded view of the seat back shown in FIG. 3.
Figure 4:
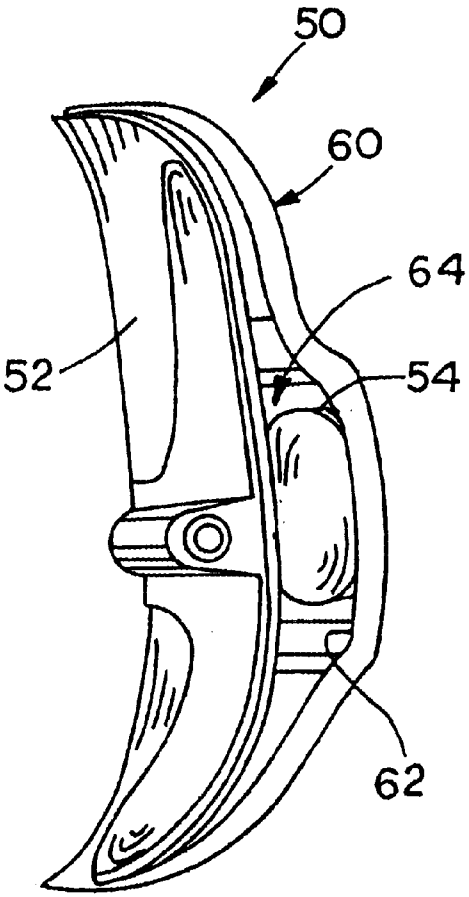
FIG. 4 is a break-away view of an end portion of the seat back shown in FIG. 3, as viewed from behind the seat back. The exemplifications set out herein illustrate at least one preferred embodiment of the invention, in one form, and such exemplifications are not to be construed as limiting the scope of the invention in any manner.
Figure 3:
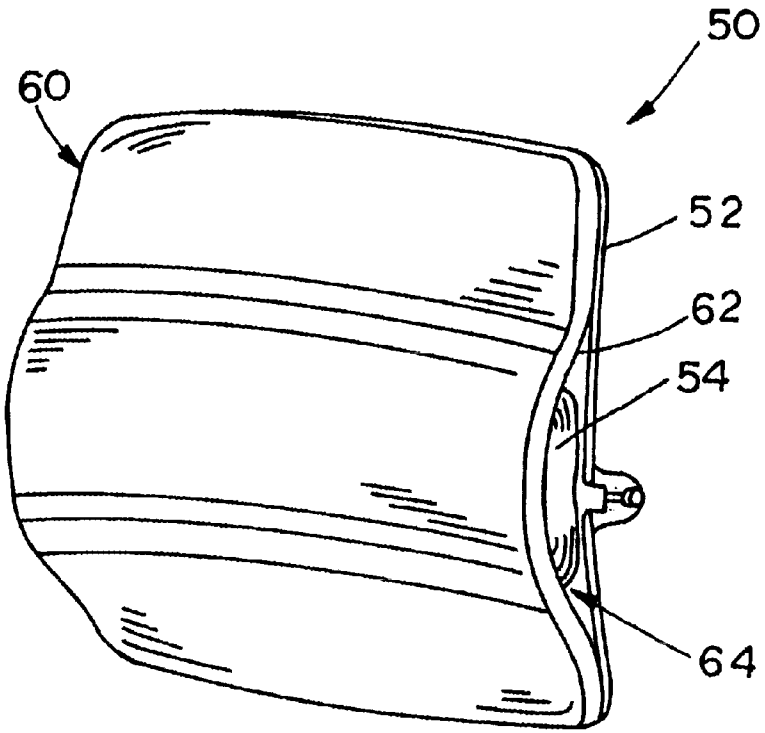
FIG. 3 is a perspective view of another embodiment of a seat back of the present invention.

In another embodiment, seat back 50 (FIGS. 2–4), much in the manner of seat back 22, includes a support 52, air bladders 54, a fluid line 56 and a valve 58. However, seat back 50, unlike seat back 22, has no flexible support member, instead relying a contoured cushion 60 for holding air bladders 54 and fluid line 56 in place relative to support 52.

Contoured cushion 60 is attached (i.e., mechanically and/or adhesively) to support 52, such attachment inherently biasing contoured cushion 60 toward support 52. Contoured cushion 60 includes a contoured portion 62, resulting in a contour gap 64 between contoured cushion 60 and support 52. Air bladders 54, a fluid line 56 and contoured cushion 60 are positioned relative to support 52 such that air bladders 54 and fluid line 56 are within contour gap 64 and such that air bladders 54 contact both support 52 and contoured portion 62. Such contact serves to hold air bladders 54 and, by way of connection therewith, fluid line 56 in place relative to support 52.

Contoured cushion 60 is advantageously composed of a material (or a combination of materials) that is capable of being molded into a particular form and that is stiff and durable enough to retain that same general form after a long period of use. Conversely, though, the material used for contoured cushion 60 also needs to be pliable enough so that it can adjust to the contours of air bladders 54 when in use. Further, the material should, ideally, be reasonably soft to promote the comfort of its user. For example, the material could be a structural foam or rubber material that could then be further upholstered, as appropriate.

Various alternate embodiments are considered to fall within the scope of the present invention. For example, article of furniture 10 may also have arm rests (not shown) and need not necessarily have legs and may or may not be cushioned, depending on its intended use. Further, instead of being a chair as set forth in the illustrated embodiment, the article of furniture may be, for example (not shown), a recliner, rocker, couch, sofa, ottoman, stool, desk, keyboard support or wrist pad for use with a keyboard support. In certain instances, seat 20 and/or the arm rests could, alternatively or additionally to seat back 22 or 50, also act as supports in the manner defined in the present embodiment. Further, the support may be designed to support any of various body parts including, for example, arms, legs, back, head or parts thereof such as wrists or feet. In a further alternative, air bladders 14 could be connected in series (not shown) using a single air line 16 therebetween, with one of air bladders 14 connected via another air line 16 to single valve 18. Additionally, flexible support member 30 may be mounted temporarily (i.e., mechanically; not shown) to support surface 24.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. An article of furniture, comprising:

a support having a support surface;

a plurality of air bladders positioned relative to said support surface, each said air bladder having expandable foam therein;

at least one fluid line fluidly coupling said air bladders together;

a single valve fluidly coupled with said at least one fluid line; and a contoured cushion positioned in association with said support surface and having an a preformed inner contoured surface defining a contour gap with said support surface, said preformed inner contoured surface generally conforming to said plurality of air bladders and solely holding said air bladders in a substantially fixed orientation relative to said support surface, said at least one fluid line and said air bladders being mounted between said support surface and said contoured cushion.

2. The article of claim 1, wherein said at least one fluid line is coupled to said air bladders in one of parallel connection of said air bladders and series connection of said air bladders.

3. The article of claim 2, wherein said at least one fluid line is coupled to said air bladders in parallel connection of said air bladders.

4. The article of claim 1, wherein said expandable foam has an expanded state, said expandable foam being characteristically biased toward said expanded state.

5. The article of claim 4, wherein said single valve is configured to be selectively closed to prevent air from flowing into said air bladders and thereby prevent further biasing of said expandable foam toward said expanded state thereof.

6. The article of claim 1, wherein said support and said contoured cushion are conjunctively configured for holding said at least one fluid line and said air bladders in place in relation to said support.

7. The article of claim 6, wherein said support is a seat back, said air bladders and said contoured cushion being configured for conjunctively providing lumbar support on said seat back.

8. The article of claim 1, wherein said air bladders are configured to be selectively contoured.

9. The article of claim 1, wherein said article of furniture is one of a chair, recliner, rocker, couch, sofa, ottoman, stool, desk, keyboard support and wrist pad for use with a keyboard support.

10. An air bladder system for use with a support of an article of furniture, comprising:

a plurality of air bladders configured for positioning relative to the support, each said air bladder having expandable foam therein;

at least one fluid line fluidly coupling said air bladders together;

a single valve fluidly coupled with said at least one fluid line; and a contoured cushion having a preformed inner contoured surface defining a contour gap, said preformed inner contoured surface generally conforming to said plurality of air bladders, said preformed inner contoured surface being configured for solely holding said plurality of air bladders in place in a substantially fixed orientation relative to the support.

11. The air bladder system of claim 10, wherein said at least one fluid line is coupled to said air bladders in one of parallel and series.

12. The air bladder system of claim 11, wherein said at least one fluid line is coupled to said air bladders in parallel.

13. The air bladder system of claim 10, wherein said expandable foam has an expanded state, said expandable foam being characteristically biased toward said expanded state.

14. The air bladder system of claim 13, wherein said single valve is configured to be selectively closed to prevent air from flowing into said air bladders and thereby prevent further biasing of said expandable foam toward said expanded state thereof.

15. The air bladder system of claim 10, wherein said air bladder system is configured to be attached one of temporarily and permanently to the support.

16. The air bladder system of claim 15, wherein said air bladder system is configured to be attached permanently to the support.

17. A method of adjusting an air bladder system associated with a support of an article of furniture, said method comprising the steps of:

providing an air bladder system in association with said support, said air bladder system including:

a plurality of air bladders positioned relative to said support, each said air bladder having expandable foam therein, said expandable foam having air therein;

at least one fluid line fluidly coupling said air bladders together;

a single valve fluidly coupled with said at least one fluid line; and a contoured cushion having a preformed inner contoured surface defining a contour gap, said preformed inner contoured surface generally conforming to said plurality of air bladders, said preformed inner contoured surface being configured for solely holding said plurality of air bladders in place in a substantially fixed orientation relative to said support;

opening said single valve;

compressing at least one said air bladder and said expandable foam associated therewith, thereby forcing at least a portion of the air from said expandable foam, said portion of the air escaping into said at least one fluid line and out through said open single valve; and closing said single valve to prevent ingress of air into said expandable foam of said at least one compressed air bladder.

18. The method of claim 17, further comprising the step of opening said single valve to allow the ingress of air into said expandable foam of said at least one compressed air bladder, thereby permitting said expandable foam to fill with air and expand.

* * * * *